US008373960B2

(12) United States Patent
Li et al.

(10) Patent No.: US 8,373,960 B2
(45) Date of Patent: Feb. 12, 2013

(54) DRIVING CIRCUIT FOR AC CONTACTOR

(75) Inventors: Chunsheng Li, Wujiang (CN); Zengliang Chang, Wujiang (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 131 days.

(21) Appl. No.: 13/105,275

(22) Filed: May 11, 2011

(65) Prior Publication Data

US 2011/0292558 A1 Dec. 1, 2011

(30) Foreign Application Priority Data

May 26, 2010 (CN) ..... 2010 1 0187580

(51) Int. Cl.
*H01H 9/00* (2006.01)

(52) U.S. Cl. ..... 361/154; 361/160

(58) Field of Classification Search ..... 361/139, 361/154, 160

See application file for complete search history.

(56) References Cited

U.S. PATENT DOCUMENTS

2006/0232907 A1* 10/2006 Huber et al. ..... 361/160
2009/0284878 A1* 11/2009 Critchley ..... 361/43

* cited by examiner

*Primary Examiner* — Danny Nguyen
(74) *Attorney, Agent, or Firm* — Kirton McConkie; Evan R. Witt

(57) ABSTRACT

Disclosed is driving circuit for AC contactor for driving a AC contactor, including a first switch connected in series with a winding of the AC contactor, a first diode reversely connected in parallel with the winding of the AC contactor for providing a discharging path for the winding, a DC startup holding unit having an output terminal connected in series with the first switch and a detection terminal connected to a first contact switch of the AC contactor. The DC startup holding unit is configured to selectively convert a DC driving voltage into a first DC voltage or a second DC voltage. When the AC contactor is not magnetized, the DC startup holding unit outputs the first DC voltage. When the AC contactor is magnetized, the DC startup holding unit outputs the second DC voltage.

11 Claims, 4 Drawing Sheets

DRIVING CIRCUIT FOR AC CONTACTOR

FIELD OF THE INVENTION

The invention is related to a driving circuit, and more particularly to a driving circuit for AC contactor.

BACKGROUND OF THE INVENTION

AC contactors, also known as electromagnetic switches, have been widely employed in the application of power control. The operating principle of AC contactor is attained by providing current to the windings of the contactor to induce a magnetic field in order to manipulate the contact switch of the AC contactor to open or close, thereby controlling the power appliance. Because the AC contactor is durable in large-current applications where the maximum allowable current is as high as 800 Ampere, and is able to readily and frequently turn on or off the power supply for high-current power appliance, e.g. 380 VAC, the AC contactor is commonly used to control the electromagnetic motor with high startup current. The AC contactor can also be employed to control factory equipment, electric heater, metal working machine, or auto-control electric apparatus, thereby fulfilling the purpose of remotely controlling the power appliance or automatically controlling the power appliance.

Referring to FIG. 1, the driving circuit for the conventional AC contactor is illustrated. In FIG. 1, the AC contactor includes a winding M and a contact switch a, such as a normally-open switch, in which the contact switch a is connected in series with the power appliance 12 and the winding M is connected in series with a switch K. When the control circuit 11 turns on the switch K, the AC voltage Vac is applied to the winding M of the AC contactor through the switch K, thereby inducing a magnetic field. Under this condition, the contact switch a is close, and thus the AC voltage Vac is applied to the power appliance 12 through the contact switch a to power the power appliance 12. On the contrary, when the control circuit 11 manipulates the switch K to turn off, the AC voltage Vac can not be applied to the winding M through the switch K. Under this condition, the contact switch a will open to prevent the AC voltage Vac from being applied to the power appliance 12 through the contact switch a. Therefore, the power appliance 12 will cease operating.

However, there is an increasing trend for the auto-control system and power appliance to use DC voltage as the operating voltage. If the driving circuit for conventional AC contactor replaces the AC voltage Vac with a DC voltage with the same magnitude, e.g. 380 VDC, the winding M of the AC contactor will burn down due to overcurrent condition when the winding M of the AC contactor is driven by the DC voltage. This is because the pick-up voltage of the AC contactor is high. If the winding M is driven by a DC voltage having the same magnitude of the AC voltage Vac, the winding M will reach saturation with small DC resistance as the winding M is steadily magnetizing. Therefore, the winding M will undergo over-current conditions and burn down accordingly. Thus, the auto-control system and power appliance using the DC voltage as the driving voltage generally employ DC contactors with higher price.

For example, the emergency power supply using DC voltage in a power system requires an additional inverter for generating an AC voltage if an AC contactor is used to control the circuitry of the emergency power supply, thereby driving the winding to operate normally. The additional inverter will increase the size of the emergency power supply and lower the power efficiency of the emergency power supply. What is worse, the additional inverter will cause a loud noise and increase the cost of the emergency power supply.

Therefore, it is necessary to address the foregoing deficiencies encountered by the conventional driving circuit for AC contactor.

SUMMARY OF THE INVENTION

It is therefore an object of the invention to provide a driving circuit for AC contactor for allowing the AC contactor to be driven by a DC voltage without being burnt down as a result of over-current conditions. Therefore, the cost of the AC contactor is lowered and the AC contactor is applicable to DC auto-control systems and power appliances with the rated current being higher than a DC contactor. In addition, the reliability of the winding of the AC contactor during magnetization can be increased and the noise caused during magnetization can be lowered. The driving circuit for AC contactor according to the invention can be applied to the DC emergency power supply without the need of an additional inverter for generating an AC voltage. Hence, the driving circuit of the invention can drive the winding of the AC contactor to operate normally. Thus, the DC emergency power supply can be made with a smaller dimension, improved power efficiency, lower noise, and reduced manufacturing cost.

To this end, a broader aspect of the invention proposes a driving circuit for driving an AC contactor. The inventive driving circuit for AC contactor includes a first switch connected in series with a winding of the AC contactor, a first diode reversely connected in parallel with the winding of the AC contactor for providing a discharging path for the winding of the AC contactor when the first switch is switched from ON state to OFF state, a DC startup holding unit for selectively converting a DC driving voltage into a first DC voltage or a second DC voltage according to the status of a contact switch. When the AC contactor is not magnetized, the DC startup holding unit outputs the first DC voltage such that the first DC voltage is applied to the winding through the first switch to induce a magnetic field. When the AC contactor is magnetized, the DC startup holding unit outputs the second DC voltage which is lower than the first DC voltage such that the second DC voltage is applied to the winding through the first switch to allow the winding to continuously induce a magnetic field.

The inventive driving circuit for AC contactor employs a first DC voltage and a second DC voltage to respectively actuate the AC contactor to be magnetized and maintain the magnetized status of the AC contactor, such that the AC contactor can be driven by DC voltage without being burnt down as a result of over-current conditions. Thus, the cost of the AC contactor using the inventive driving circuit is lowered and the AC contactor using the inventive driving circuit is applicable to DC auto-control systems and power appliances with the rated current being higher than a DC contactor. In addition, the reliability of the AC contactor during magnetization can be increased and the noise caused during magnetization can be lowered. The driving circuit for AC contactor according to the invention can be applied to the DC emergency power supply without the need of an additional inverter for generating an AC voltage. Hence, the driving circuit of the invention can drive the winding of the AC contactor to operate normally. Thus, the DC emergency power supply can be made with a smaller dimension, improved power efficiency, lower noise, and reduced manufacturing cost.

Now the foregoing and other features and advantages of the present invention will be best understood through the following descriptions with reference to the accompanying drawings, wherein:

DETAILED DESCRIPTION OF THE PREFERRED EMBODIMENT

An exemplary embodiment embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as limitative.

Figure 1:
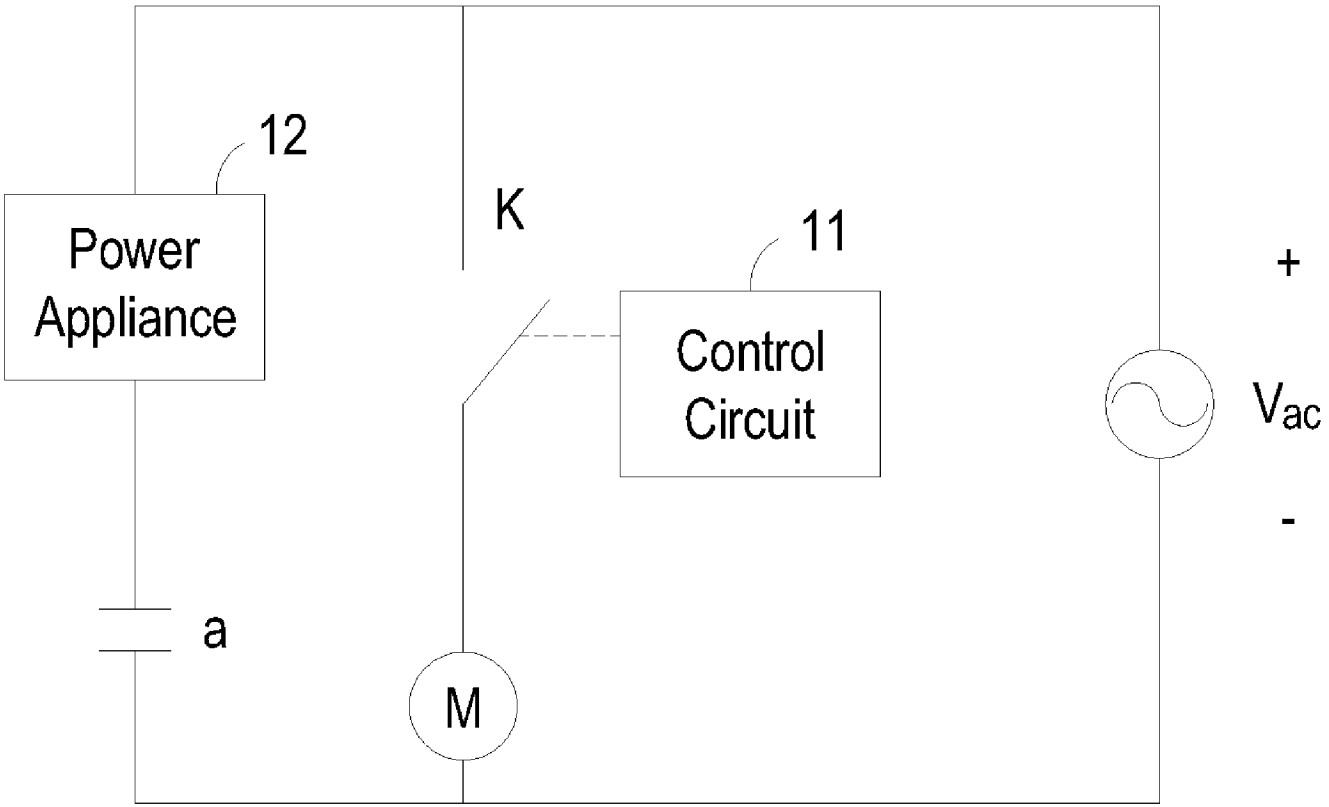
FIG. 1 PRIOR ART
FIG. 1 is a circuit block diagram showing the driving circuit for AC contactor according to the prior art.
Figure 2:
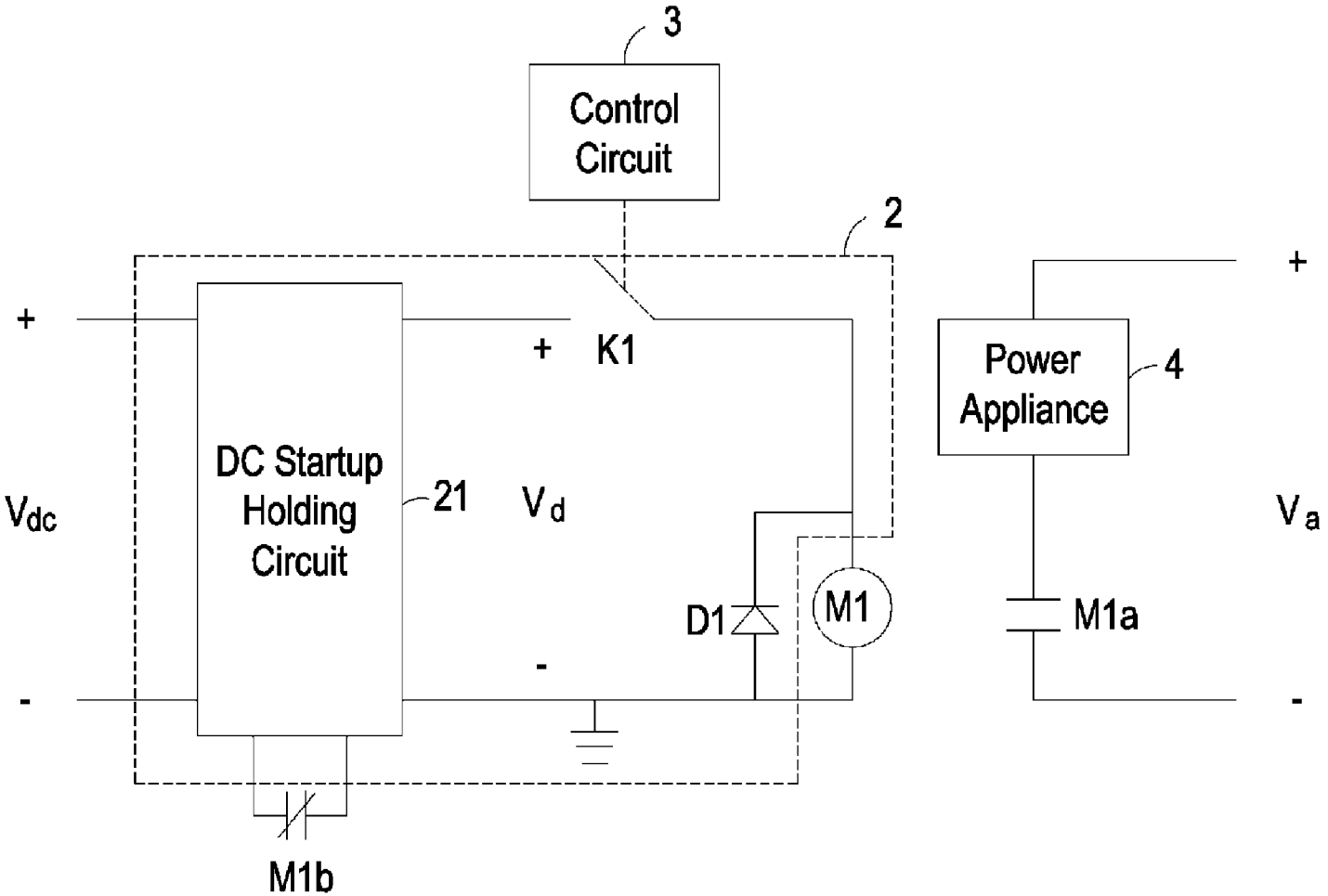
FIG. 2 is a circuit block diagram showing the driving circuit for AC contactor according to one embodiment of the invention.

Referring to FIG. 2, the circuit block diagram of the driving circuit for AC contactor according to one embodiment of the invention is shown. In FIG. 2, the driving circuit 2 includes a first switch K1, a first diode D1, and a DC startup holding unit 21. The first diode D1 and the winding M1 of the AC contactor are reversely connected in parallel with each other, thereby providing a discharging path for the winding M1 when the first switch K1 is switched from ON state to OFF state. The first switch K1 is connected between the winding M1 and the output terminal of the DC startup holding unit 21 such that the first switch K1 and the winding M1 are serially connected with each other. In this manner, the ON/OFF operation of the first switch K1 is manipulated by the control circuit 3. The output terminal of the DC startup holding unit 21 is connected in series with the first switch K1. The detection terminal of the DC startup holding unit 21 is connected to the first contact switch M1*b* of the AC contact. The input terminal of the DC startup holding unit 21 is used to receive a DC driving voltage Vdc and selectively convert the DC driving voltage into a first DC voltage V1 or a second DC voltage V2 according to the status of the first contact switch M1*b*.

In the instant embodiment, the first contact switch M1*b* is a normally-closed switch, and the DC startup holding unit 21 is used to determine that the AC contactor is magnetized by determining that the first contact switch M1*b* is open and determine that the AC contactor is not magnetized by determining that the first contact switch M1*b* is close. Alternatively, the first contact switch may be a normally-open switch, and the DC startup holding unit 21 is used to determine that the AC contactor is magnetized by determining that the first contact switch M1*b* is close and determine that the AC contactor is not magnetized by determining that the first contact switch M1*b* is open.

According to the invention, when the AC contactor is not magnetized, the DC startup holding unit 21 outputs a first DC voltage V1 being lower than the rated AC voltage (AC 380V) of the winding M1. That is, the output voltage Vd of the DC startup holding unit 21 is identical to the first DC voltage V1 having a voltage level of 300-330V. When the AC contactor is magnetized, the DC startup holding unit 21 output a second DC voltage V2 being lower than the first DC voltage V1. That is, the output voltage Vd of the DC startup holding unit 21 is identical to the second DC voltage V2 having a voltage level of 48V.

In general, when the control circuit 3 manipulates the first switch K1 to switch from OFF state to ON state, the AC contactor is not magnetized. Under this condition, the DC startup holding unit 21 outputs the first DC voltage V1 and a magnetic field is induced by applying the first DC voltage V1 to the winding M1 of the AC contactor through the first switch K1. After a period of time, e.g. 3 seconds, the first contact switch M1*b* will switch from non-magnetized state to magnetized state as a result of the magnetic field induced by the winding M1. In the instant embodiment, the first contact switch M1*b* will switch from close state to open state and the second contact switch M1*a* will switch from open state to close state, thereby applying the appliance voltage Va to the power appliance 4 through the second contact switch M1*a*. In the meantime, the DC startup holding unit 21 determines that the AC contactor is magnetized according to the openness of the first contact switch M1*b*, and outputs the second DC voltage V2 accordingly to allow the winding M1 of the AC contactor to continuously induce a magnetic field.

In other words, the inventive driving circuit 2 for AC contactor employs a first DC voltage V1 having a voltage level of 300-330 V and being lower than the rated AC voltage of 380V to actuate the winding M1 of the AC contactor, thereby magnetizing the AC contactor. It is noteworthy that the voltage level of the first DC voltage is adaptable depending on the type of the contactor. After the AC contactor is magnetized, the inventive driving circuit 2 for the AC contactor employs a second DC voltage V2 having a voltage level of 48V and being lower than the first DC voltage V1 to allow the winding M1 of the AC contactor to continuously induce a magnetic field, thereby keeping the AC contactor magnetized.

Because the first DC voltage V1 used to actuate the AC contactor is lower than the rated AC voltage and constantly provided for the AC contactor, the AC contactor can be magnetized without burning down the winding M1 as a result of over-current conditions. Also, after the AC contactor is magnetized, the second DC voltage V2 which is lower than the first DC voltage V1 is employed to keep the AC contactor magnetized. Accordingly, the winding M1 of the AC contactor can be prevented from reaching saturation after the AC contactor is magnetized, thereby preventing the current of the winding M1 from increasing and preventing the winding M1 from being burnt down. Furthermore, by employing the second DC voltage V2 which is lower than the first DC voltage V1 to keep the AC contactor magnetized, the power consumption of the AC contactor can be lessened and the power efficiency of the AC contactor can be enhanced. In addition, the reliability of the winding M1 of AC contactor in magnetization can be improved and the noise caused during magnetization can be reduced. Compared to the prior art that employs AC voltage to keep the winding M1 magnetized, the invention employs a second DC voltage V2 to keep the winding M1 magnetized so as to stabilize the magnetic field without touching the zero-crossing point.

Figure 3:
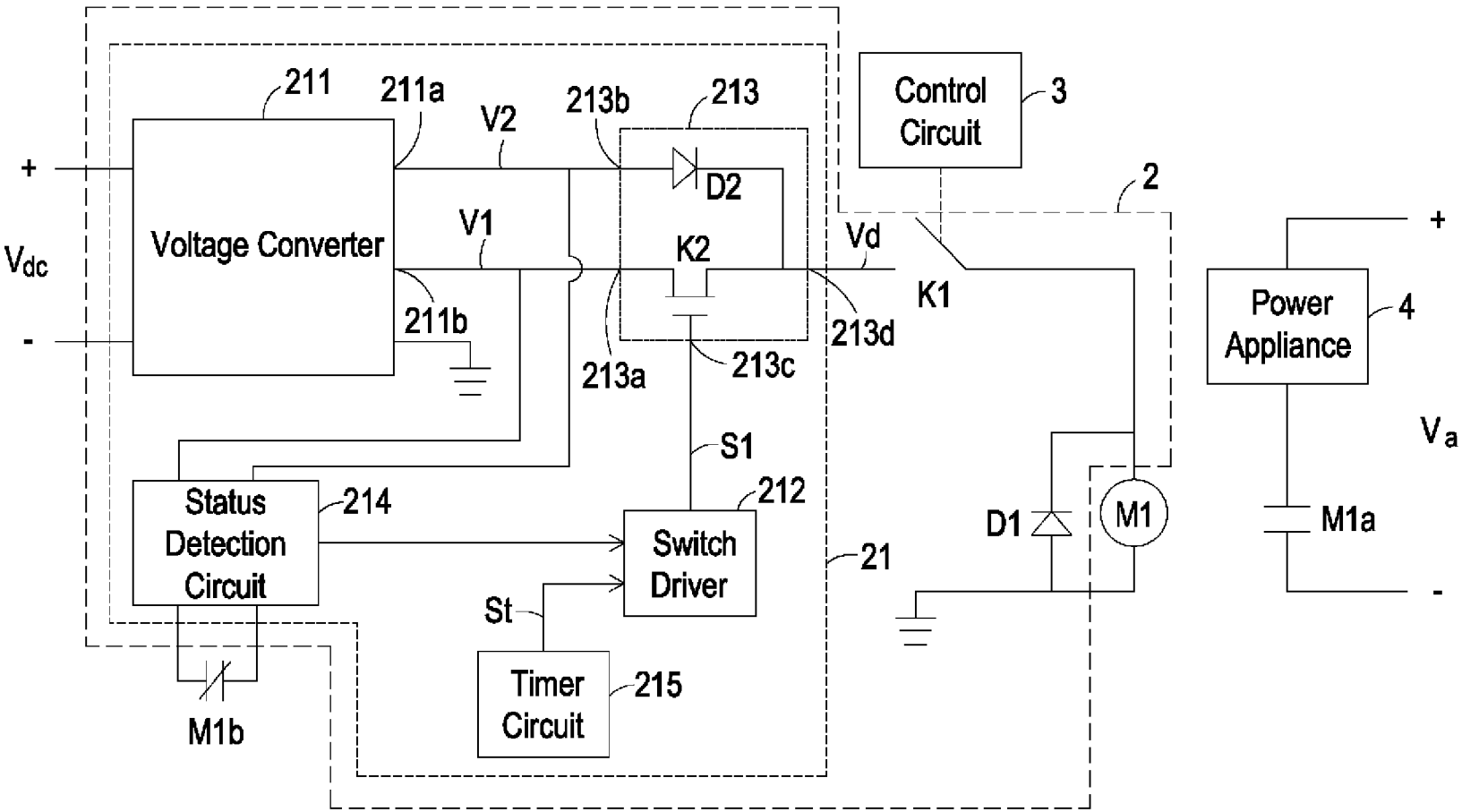
FIG. 3 is a circuit block diagram showing the detailed circuitry of the driving circuit for AC contactor according to one embodiment of the invention.

Referring to FIGS. 2 and 3, in which FIG. 3 is a circuit block diagram showing the detailed circuitry of the driving circuit for AC contactor according to one embodiment of the invention. As shown in FIG. 3, the DC startup holding unit 21 includes a voltage converter 211, a switch driver circuit 212, a selection switch circuit 213, a status detection circuit 214, and a timer circuit 215. The voltage converter 211 has a first input terminal 211*a* connected to the first input terminal 213*a* of the selection switch circuit 213 and a second input terminal 211*b* connected to the second input terminal 213*b* of the selection switch circuit 213. The voltage converter 211 is used to convert the DC driving voltage Vdc into a first DC voltage V1 and a second DC voltage V2. The switch driver circuit 212 is connected to the control terminal 213*c* of the switch driver circuit 213, the status detection circuit 214, and the timer circuit 215 for driving the selection switch circuit 213 according to the driving signal S1 outputted therefrom.

The output terminal 213*d* of the selection switch circuit 213 is connected in series with the winding M1 of the AC contactor and the first switch K1 for selectively outputting the first DC voltage V1 or the second DC voltage V2 to the winding M1 of the AC contactor according to the driving signal S1. In the instant embodiment, the selection switch circuit 213 includes a second diode D2 and a second switch K2. The second diode D2 is connected between the second input terminal 213*b* of the selection switch circuit 213 and the output terminal 213*d* of the selection switch circuit 213. The second switch K2 is connected between the first input terminal 213*a* of the selection switch circuit 213 and the output terminal 213*d* of the selection switch circuit 213. The control terminal of the second switch K2 is connected to the switch driver circuit 212. The switch driver circuit 212 drives the second switch K2 to turn on or off according to the driving signal generated thereby. Because the first DC voltage V1 is higher than the second DC voltage V2, the selection switch circuit 213 outputs the first DC voltage V1 when the second switch K2 is turned on. Under this condition, the output voltage Vd of the DC startup holding unit 21 is identical to the first DC voltage V1. When the second switch K2 is turned off, the selection switch circuit 213 outputs the second DC voltage V2. Under this condition, the output voltage Vd of the DC startup holding unit 21 is identical to the second DC voltage V2.

The status detection circuit 214 is connected to the first output terminal 211*a* of the voltage converter 211, the second output terminal 211*b* of the voltage converter 211, the switch driver circuit 212, and the first contact switch M1*b* for detecting the first DC voltage V1, the second DC voltage V2, and status of the first contact switch M1*b* and manipulating the switch driver circuit 212 to drive the selection switch circuit 213 according to the first DC voltage V1, the second DC voltage V2, or the status of the first contact switch M1*b*. As a result, the selection switch circuit 213 may output either the first DC voltage V1 or the second DC voltage V2.

The timer circuit 215 is connected to the switch driver circuit 212 for limiting the startup period that the switch driver circuit 212 drives the selection switch circuit 213 to output the first DC voltage V1, in order to prevent the startup period from becoming overlong to cause the winding M1 of the AC contactor to be burnt down as a result of over-current conditions. In the instant embodiment, the timer circuit 215 may be a 555 timer IC and the timing signal St outputted from the timer circuit 215 is used to limit the startup period that the switch driver circuit 212 drives the selection switch circuit 213 to output the first DC voltage V1.

In the instant embodiment, when the control circuit 3 manipulates the first switch K1 to switch from OFF state to ON state, the status detection circuit 214 determines that the AC contactor is not magnetized according to the closeness of the first contact switch M1*b* and manipulates the switch driver circuit 212 to drive the selection switch circuit 213 to output the first DC voltage V1 accordingly. Under this condition, the second switch K2 is turned on and the first DC voltage V1 is applied to the winding M1 of the AC contactor through the first switch K1 to induce a magnetic field. After a period of time, the first contact switch M1*b* will switch from non-magnetized state to magnetized state according to the magnetic field induced by the winding M1, such that the first contact switch M1*b* switches from close state to open state and the second contact switch M1*a* switches from open state to close state to allow the appliance voltage Va to be applied to the power appliance 4 through the second contact switch M1*a*. In the meantime, the status detection circuit 214 determines that the AC contactor is magnetized according to the openness of the first contact switch M1*b* and manipulates the switch driver circuit 212 to drive the selection switch circuit 213 to output the second DC voltage V2. Under this condition, the second switch K2 is turned off to allow the second DC voltage V2 to be applied to winding M1 of the AC contactor through the first switch K1, thereby maintaining the magnetic field induced by the winding M1.

In the instant embodiment, if the first DC voltage V1 or the second DC voltage V2 becomes abnormal, the status detection circuit 214 manipulates the switch driver circuit 212 to drive the selection switch circuit 213 to output the second DC voltage V2. Under this condition, the second switch K2 is turned off to prevent the winding M1 of the AC contactor from being burnt down as a result of over-current conditions.

Figure 4:
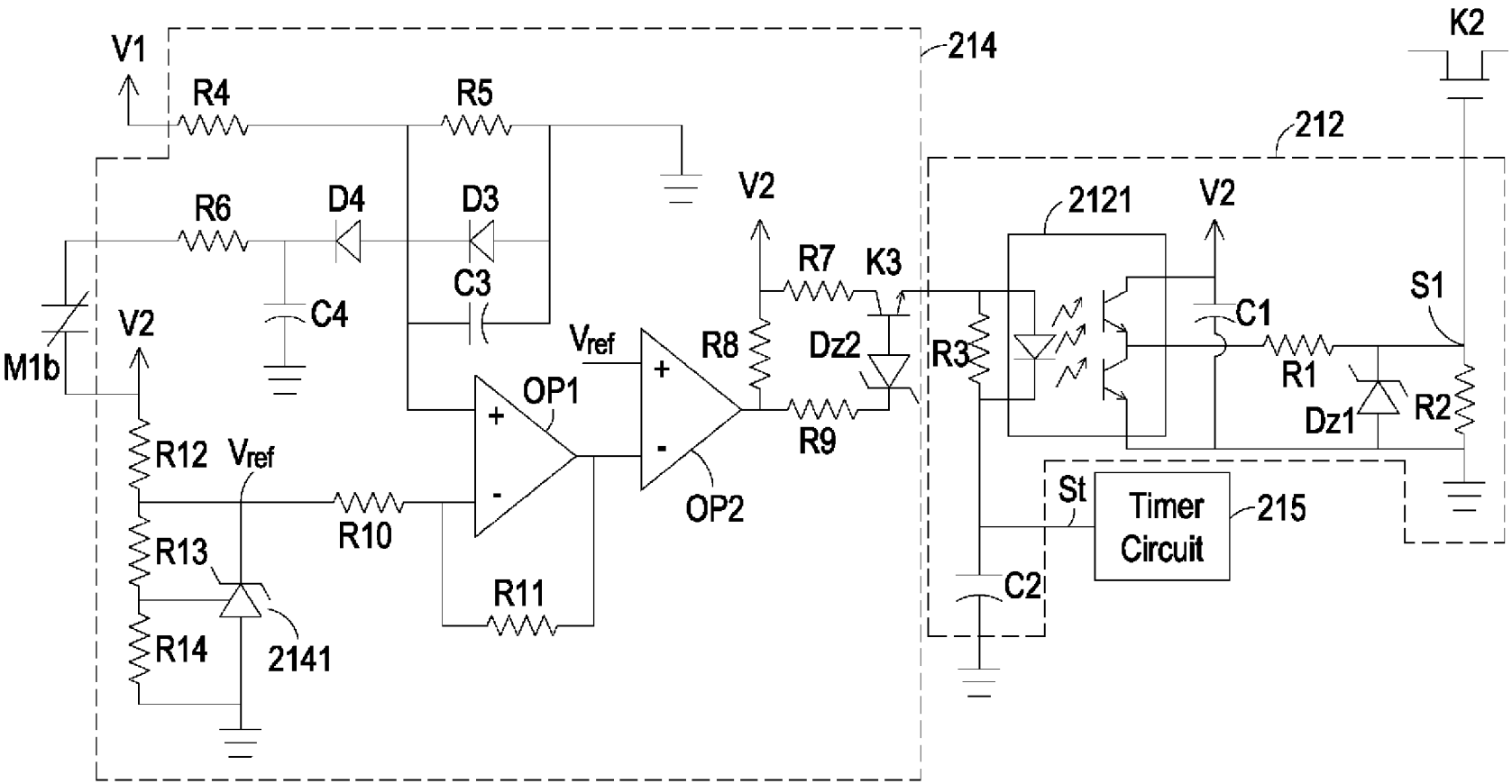
FIG. 4 is circuit block diagram showing the circuitry of the switch driver circuit and status detection circuit of the driving circuit shown in FIG. 3.

The voltage converter 211, the switch driver circuit 212, the selection switch circuit 213, the status detection circuit 214, and the timer circuit 215 may be implemented by various circuit configurations. Next, an exemplary embodiment will be given to illustrate the circuit configuration of the switch driver circuit 212 and the status detection circuit 214 of the inventive driving circuit. Referring to FIGS. 2, 3 and 4, in which FIG. 4 is circuit block diagram showing the circuitry of the switch driver circuit 212 and status detection circuit 214 of the driving circuit shown in FIG. 3. In FIG. 4, the switch driver circuit includes a photo coupling isolation element 2121, a first capacitor C1, a second capacitor C2, a first resistor R1, a second resistor R2, a third resistor R3, and a first zener diode Dz1. The first resistor R1 is connected to an output terminal of the photo coupling isolation element 2121, and the second resistor R2 is connected in series with the first resistor R1. The first zener diode Dz1 is connected in parallel with the second resistor R2, and the control terminal of the second switch K2 is connected to the first resistor R1, the second resistor R2, and one end of the first zener diode Dz1. The first capacitor C1 is connected in parallel with an output terminal of the photo coupling isolation element 2121, and the third resistor R3 is connected in parallel with an input terminal of the photo coupling isolation element 2121. The second capacitor C2 is connected to the third resistor R3 and the output terminal of the timer circuit 215.

In the instant embodiment, the status detection circuit includes a comparing circuit and a reference voltage generator, in which the comparing circuit includes resistors R4-R11, diodes D3 and D4, capacitors C3 and C4, a second zener diode Dz2, operational amplifiers OP1 and OP2, and a third switch K3. The reference voltage generator includes resistors R12-R14 and a voltage regulator 2141. The fourth resistor R4 is connected in series with the fifth resistor R5. The third diode D3, the third capacitor C3, and the fifth resistor R5 are connected in parallel with each other. The third diode D3, the fourth diode D4, the fourth resistor R4, the firth resistor R5, and one end of the third capacitor C3 are connected to the positive input terminal of the first operational amplifier OP1. The fourth diode D4, the sixth resistor R6, and one end of the fourth capacitor C4 are connected with each other. One end of the sixth resistor R6 is connected to one end of the first contact switch M1*b*. The tenth resistor R10 is connected between the negative input terminal of the first operational amplifier OP1 and the cathode of the voltage regulator 2141. The eleventh resistor R11 is connected between the negative input terminal of the first operational amplifier OP1 and the output terminal of the first operational amplifier OP1. The negative input terminal of the second operational amplifier OP2 is connected to the output terminal of the first operational amplifier OP1. The seventh resistor R7 is connected between the eighth resistor R8 and the third switch K3. The eighth resistor R8 is connected between the seventh resistor R7 and the ninth resistor R9. The ninth resistor R9 and the second zener diode Dz2 are connected in series between the control terminal of the third switch K3 and the output terminal of the second operational amplifier OP2.

In the instant embodiment, the reference voltage Vref generated by the reference voltage generator is provided for the comparing circuit. The comparing circuit is used to determine if the AC contactor is magnetized by the status of the first contact switch M1*b*. The twelfth resistor R12, the thirteenth resistor R13, and the fourteenth resistor R14 are connected in series with each other, and the twelfth resistor R12 is connected between one end of the first contact switch M1*b* and the cathode of the voltage regulator 2141. The thirteenth resistor R13 is connected between the cathode of the voltage regulator 2141 and the reference terminal. The fourteenth resistor R14 is connected between the anode of the voltage regulator 2141 and the reference terminal.

In the instant embodiment, when the contact switch M1*b* is close, the AC contactor is determined to be non-magnetized. Under this condition, the comparing circuit manipulates the switch driver circuit 212 to drive the second switch K2 of the selection switch circuit 213 to turn on. On the contrary, when the contact switch M1*b* is open, the AC contactor is determined to be magnetized. Under this condition, the comparing circuit manipulates the switch driver circuit 212 to drive the second switch K2 of the selection switch circuit 213 to turn off. The first switch K1 and the second switch K2 may be implemented by bipolar junction transistor (BJT), metal-oxide-semiconductor field-effect transistor (MOSFET), insulated-gate bipolar transistor (IGBT), or relay. The voltage regulator 2141 may be implemented by LM-431 adjustable precision zener shunt regulator manufactured by National Semiconductor Corporation.

In conclusion, the driving circuit for AC contactor according to the invention employs a first DC voltage and a second DC voltage to drive the AC contactor to be magnetized and maintain the magnetized status of the AC contactor, respectively. In this manner, the AC contactor can be driven by DC voltage without being burnt down as a result of over-current conditions. Hence, the cost of the AC contactor can be reduced, and the AC contactor with the rated current being lower than the rated current of the DC contactor can be applied to the DC auto-control system and power appliances. Also, the reliability of the AC contactor during magnetization can be increased, and the noise caused during magnetization can be lowered. The inventive driving circuit for AC contactor does not need an additional inverter for generating an AC voltage when the AC contactor is applied to the DC emergency power supply. Therefore, the DC emergency power supply can be downsized and improved in terms of power efficiency.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A driving circuit for driving an AC contactor, comprising:

a first switch connected in series with a winding of the AC contactor;

a first diode reversely connected in parallel with the winding of the AC contactor for providing a discharging path for the winding of the AC contactor when the first switch is switched from ON state to OFF state; and a DC startup holding unit having an output terminal connected in series with the first switch and a detection terminal connected to a contact switch of the AC contactor for selectively converting a DC driving voltage into a first DC voltage or a second DC voltage according to a status of the first contact switch of the AC contactor;

wherein when the AC contactor is not magnetized, the DC startup holding unit outputs the first DC voltage to allow the first DC voltage to be applied to the winding of the AC contactor through the first switch, thereby inducing a magnetic field, and wherein when the AC contactor is magnetized, the DC startup holding unit outputs the second DC voltage being lower than the first DC voltage to allow the second DC voltage to be applied to the winding of the AC contactor through the first switch, thereby maintaining the magnetic field.

2. The driving circuit according to claim 1 wherein the first contact switch of the AC contactor is a normally-close switch or a normally-open switch.

3. The driving circuit according to claim 2 wherein the DC startup holding unit is configured to determine whether the AC contactor is magnetized or not by determining whether the first contact switch is open or close.

4. The driving circuit according to claim 1 wherein the DC startup holding unit includes:

a voltage converter for converting the DC driving voltage into a first DC voltage or a second DC voltage;

a selection switch circuit having a first input terminal connected to a first output terminal of the voltage converter and a second input terminal connected to a second output terminal and an output terminal connected in series with the first switch and the winding for selectively outputting the first DC voltage or the second DC voltage to the winding;

a switch driver circuit connected to a control terminal of the selection switch circuit for outputting a driving signal to drive the selection switch circuit; and a status detection circuit connected to the voltage converter, the switch driver circuit, and the first contact switch for detecting the first DC voltage and the second DC voltage and the status of the first contact switch and manipulating the switch driver circuit to drive the selection switch circuit according to the first DC voltage, the second DC voltage, or the status of the first contact switch, thereby allowing the selection switch circuit to output the first DC voltage or the second DC voltage.

5. The driving circuit according to claim 4 wherein when the first DC voltage or the second DC voltage is abnormal, the status detection circuit manipulates the switch driver circuit to drive the selection switch circuit to output the second DC voltage.

6. The driving circuit according to claim 4 wherein the selection switch circuit includes:

a second diode connected between the second input terminal and the output terminal of the selection switch circuit; and a second switch connected between the first input terminal and the output terminal of the selection switch circuit and having a control terminal connected to the switch driver circuit for being driven by the driving signal outputted from the switch driver circuit to be turned on or off.

7. The driving circuit according to claim 4 wherein the DC startup holding unit includes:

a timer circuit connected to the switch driver circuit for limiting a startup period that the switch driver circuit drives the selection switch circuit to output the first DC voltage.

8. The driving circuit according to claim 7 wherein the timer circuit is implemented by a 555 timer IC and a timing signal outputted from the timer circuit is configured to limit the startup period.

9. The driving circuit according to claim 7 wherein the switch driver circuit includes a photo coupling isolation element, a first capacitor, a second capacitor, a first resistor, a second resistor, a third resistor, and a zener diode, wherein the first resistor is connected to an output terminal of the photo coupling isolation element and the second resistor is connected in series with the first resistor, and wherein the zener diode is connected in parallel with the second resistor and the control terminal of the selection switch circuit is connected to the first resistor, the second resistor, and one end of the zener diode, and wherein the first capacitor is connected in parallel with the output terminal of the photo coupling isolation element and the third resistor is connected in parallel with an input terminal of the photo coupling isolation element, and wherein the second capacitor is connected to the third resistor and an output terminal of the timer circuit.

10. The driving circuit according to claim 1 wherein switch driver circuit includes a comparing circuit and a reference voltage generator for generating a reference voltage for the comparing circuit to detect the status of the first contact switch to determine whether the AC contactor is magnetized.

11. The driving circuit according to claim 1 wherein the first DC voltage is lower than a rated AC voltage of the winding.

* * * * *